US008526860B2

(12) United States Patent
Kim

(10) Patent No.: US 8,526,860 B2
(45) Date of Patent: Sep. 3, 2013

(54) DEVELOPING UNIT AND IMAGE FORMING APPARATUS HAVING THE SAME

(75) Inventor: Jin Hong Kim, Incheon (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 399 days.

(21) Appl. No.: 12/788,599

(22) Filed: May 27, 2010

(65) Prior Publication Data

US 2011/0069994 A1 Mar. 24, 2011

(30) Foreign Application Priority Data

Sep. 18, 2009 (KR) ..... 2009-88543

(51) Int. Cl.
*G03G 15/08* (2006.01)
*G03G 21/10* (2006.01)

(52) U.S. Cl.
USPC ..... 399/258; 399/120; 399/358; 399/360

(58) Field of Classification Search
USPC ..... 399/258, 358, 360, 120
See application file for complete search history.

(56) References Cited

U.S. PATENT DOCUMENTS

| | | | | |
|---|---|---|---|---|
| 7,561,835 | B2 * | 7/2009 | Tanaka et al. | 399/120 X |
| 2001/0043826 | A1 * | 11/2001 | Mizoguchi et al. | 399/120 X |
| 2008/0019738 | A1 * | 1/2008 | Yoon et al. | 399/258 |
| 2009/0304413 | A1 * | 12/2009 | Jeon et al. | 399/258 |

* cited by examiner

*Primary Examiner* — Sophia S Chen
(74) *Attorney, Agent, or Firm* — Stanzione & Kim, LLP

(57) ABSTRACT

A developing unit to deliver developer in various directions or a predetermined direction, and an image forming apparatus having the same. The developing unit includes a developer housing and a delivery unit to provide the developer with a delivery force via rotation thereof. The developer housing includes a protrusion to interfere with the delivery unit during rotation of the delivery unit, so as to change a developer delivery direction. The delivery unit includes an elastic delivery member and in turn, the delivery member includes a plurality of delivery elements to interfere with the protrusion. The developer delivery direction may be changed variously by changing positions of the delivery element and the protrusion.

22 Claims, 15 Drawing Sheets

DEVELOPING UNIT AND IMAGE FORMING APPARATUS HAVING THE SAME

CROSS-REFERENCE TO RELATED APPLICATIONS

This application claims priority under 35 U.S.C. §119(a) from Korean Patent Application No. 2009-0088543, filed on Sep. 18, 2009 in the Korean Intellectual Property Office, the disclosure of which is incorporated herein by reference.

BACKGROUND

1. Field of the Invention

Embodiments of the present general inventive concept relate to a developing unit to deliver developer in a predetermined direction and an image forming apparatus having the same.

2. Description of the Related Art

Generally, image forming apparatuses are devised to form an image on a printing medium according to inputted image signals. Examples of image forming apparatuses include printers, copiers, facsimiles, and so-called multi-functional devices that combine some of the functionalities of the aforementioned devices.

In operation of an image forming apparatus, light is irradiated to a photosensitive body that has been charged with a predetermined electric potential, so as to form an electrostatic latent image on a surface of the photosensitive body. As toner as developer is supplied to the electrostatic latent image, a visible toner image is formed. The toner image formed on the photosensitive body is directly transferred to a printing medium or is indirectly transferred to the printing medium by way of an intermediate transfer body. The transferred image is fused to the printing medium via a fusing process.

The above-described printing process may need delivery of the developer. Conventionally, delivery of the developer is accomplished by an agitator or an auger.

However, the agitator or the auger is designed to deliver the developer in a direction perpendicular to a rotating axis thereof, having a limit in a delivery direction of the developer.

SUMMARY

Therefore, it is a feature and utility an aspect of the present general inventive concept to provide a developing unit to deliver developer in a predetermined direction and an image forming apparatus having the same.

Additional features and utilities of the present general inventive concept will be set forth in part in the description which follows and, in part, will be obvious from the description, or may be learned by practice of exemplary embodiments of the present general inventive concept.

Embodiments of the present general inventive concept provide a developing unit to deliver developer in various directions or in a predetermined direction and an image forming apparatus having the same.

Embodiments of the present general inventive concept may include a developing unit detachably mounted in an image forming apparatus and may include a developing roller and a supply roller to supply developer to a photosensitive body, the developing unit may further include a developer housing to store the developer, and a delivery unit to deliver the developer by being rotated in the developer housing, the delivery unit may include a rotating shaft, and a delivery member coupled to the rotating shaft and arranged to come into contact with the developer via rotation thereof, the delivery member may include at least one delivery element arranged in an axial direction of the rotating shaft, and the developer housing including at least one protrusion arranged to interfere with the at least one delivery element during rotation of the delivery unit.

The at least one protrusion may be arranged at a position close to any one side of the at least one delivery element on the basis of the center of the at least one delivery element, so as to cause bending of a side portion of the at least one delivery element.

The at least one protrusion may be arranged close to a left side of a surface of the at least one delivery element so as to come into contact with the at least one delivery element when the surface of the at least one delivery element is intended to face a direction deflected leftward from a rotation tangential direction of the delivery unit.

The at least one protrusion may be arranged close to a right side of a surface of the at least one delivery element so as to come into contact with the at least one delivery element when the surface of the at least one delivery element is intended to face a direction deflected rightward from a rotation tangential direction of the delivery unit.

The at least one delivery element may be formed by dividing the delivery member into a plurality of delivery elements, and the at least one protrusion may be arranged to correspond to the surface of the at least one delivery element.

The at least one protrusion may include a plurality of protrusions arranged in a line in an axial direction of the rotating shaft of the delivery unit.

The at least one protrusion may include a plurality of protrusions arranged in zigzags in an axial direction of the rotating shaft of the delivery unit.

The delivery member may include an elastic thin film member.

An angle between the surface of the at least one delivery element and the direction deflected from the rotation tangential direction of the delivery unit may be an acute angle.

Embodiments of the present general inventive concept may include an image forming apparatus having a developer delivery system, the developer delivery system may include a developer housing to store the developer, and a delivery unit to deliver the developer by being rotated in the developer housing, the delivery unit may include a rotating shaft, and a delivery member coupled to the rotating shaft and adapted to provide the developer with delivery force via rotation thereof, the delivery member may include at least one delivery element arranged in an axial direction of the rotating shaft, and the developer housing may include a direction change element to change a direction of the developer delivery force by causing the at least delivery element to be bent in a predetermined direction during rotation of the delivery unit.

The direction change element may include at least one protrusion formed in the developer housing.

The at least one protrusion may be arranged within a rotation radius of the at least one delivery element, so as to come into contact with the at least one delivery element.

The at least one protrusion may be arranged at a position to apply deformation force to the at least one delivery element, so as to allow an orientation direction of a surface of the at least one delivery element to be changed from a first direction as a rotation tangential direction of the delivery unit to a second direction as a predetermined delivery force application direction.

Embodiments of the present general inventive concept may include a developer delivery system that may include a developer housing to store developer, and a delivery unit to deliver the developer by being rotated in the developer housing, the delivery unit may include a rotating shaft, and a film member coupled to the rotating shaft and adapted to push and deliver the developer in a predetermined direction, the film member may include at least one delivery element arranged in an axial direction of the rotating shaft, and the developer housing may include at least one interference member formed in the developer housing and adapted to interfere with the at least one delivery element during rotation of the delivery unit so as to change a developer push direction.

Embodiments of the present general inventive concept may include a waste developer return unit that may include a waste developer housing into which waste developer is introduced, and a delivery unit to deliver the waste developer by being rotated in the waste developer housing, the delivery unit may include a rotating shaft, and a delivery member coupled to the rotating shaft and adapted to push and deliver the developer in a predetermined direction via rotation thereof, the delivery member may include at least one delivery element arranged in an axial direction of the rotating shaft, and the waste developer housing may include at least one protrusion protruding from an inner surface of the waste developer housing and adapted to come into contact with the at least one delivery element so as to change an orientation direction of a surface of the at least one delivery element.

Embodiments of the present general inventive concept further include a developing unit within an image forming apparatus including a developer housing to store a developer, and a delivery unit to rotatably deliver the developer along a developer delivery direction, wherein the delivery unit further includes a rotating shaft and flexible driving member attached thereto to direct the developer along the developer delivery direction, and the developer housing further includes a plurality of protrusions along an inner surface thereof to provide multiple developer delivery directions of the developer within the developer housing at separate time intervals.

Embodiments of the present general inventive concept further include a method of modifying developer delivery direction within a developer unit of an image forming apparatus including rotating a delivery unit with an elongated delivery member within a developer housing of the developer unit; and colliding the delivery member with at least one protrusion positioned on an inner surface of the developer housing.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings in which.

DETAILED DESCRIPTION OF THE EXEMPLARY EMBODIMENTS

Figure 1:
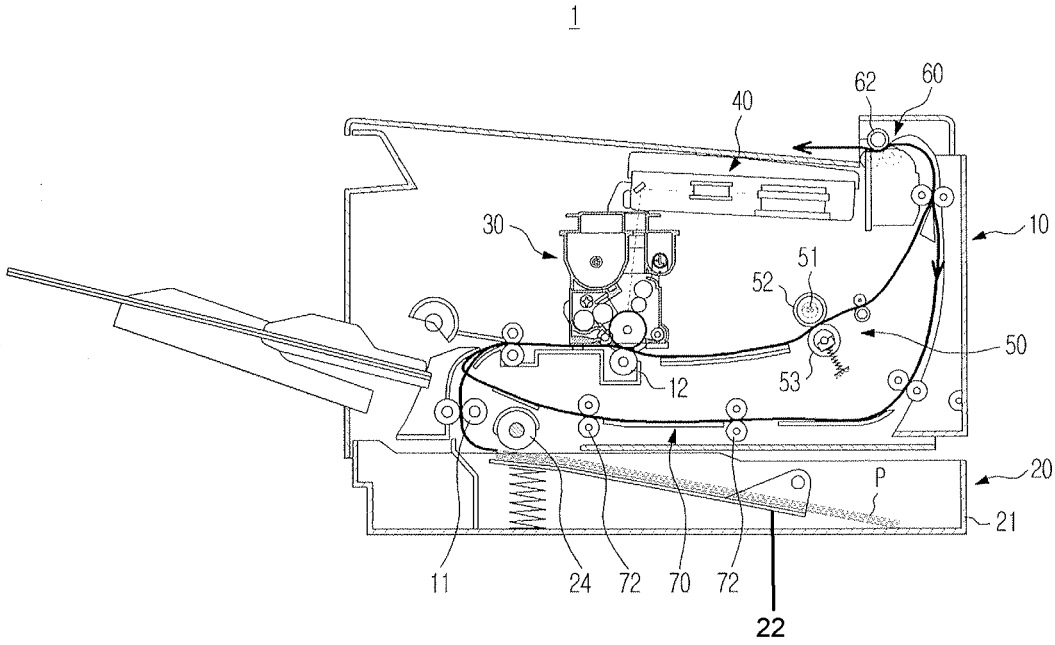
FIG. 1 is a view illustrating an interior configuration of an image forming apparatus according to an exemplary embodiment of the present general inventive concept.

Reference will now be made in detail to the exemplary embodiments of the present general inventive concept, examples of which are illustrated in the accompanying drawings, wherein like reference numerals refer to like elements throughout. The exemplary embodiments are described below in order to explain the present general inventive concept by referring to the figures.

Figure 2:
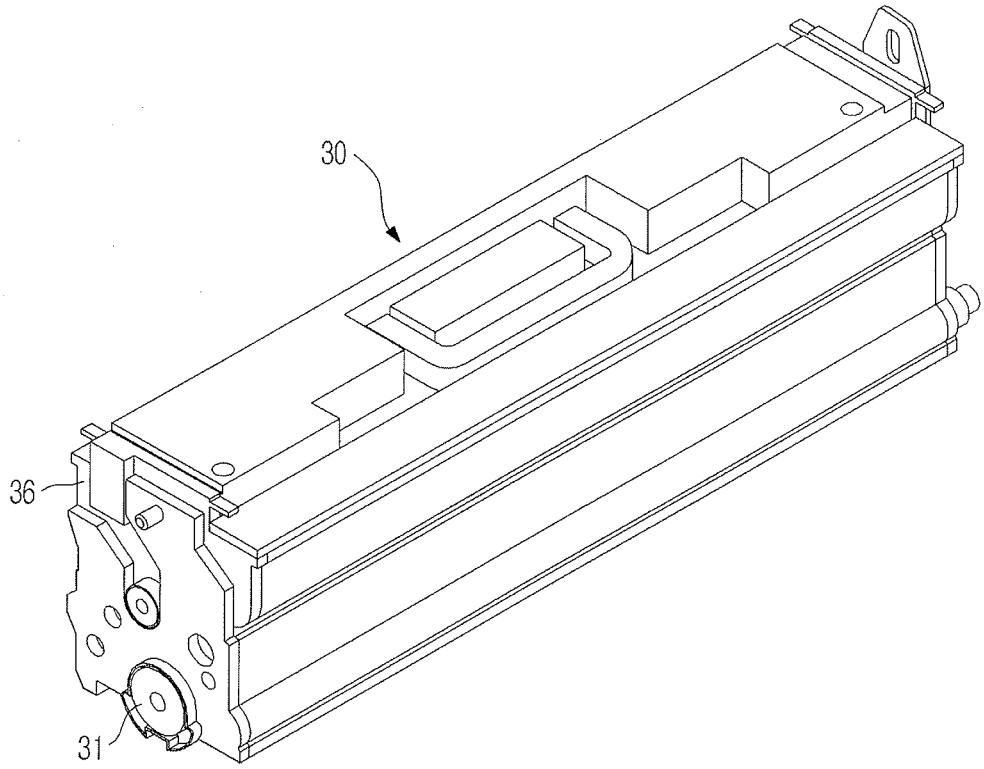
FIG. 2 is a perspective view illustrating an exterior appearance of a developing unit.
Figure 3:
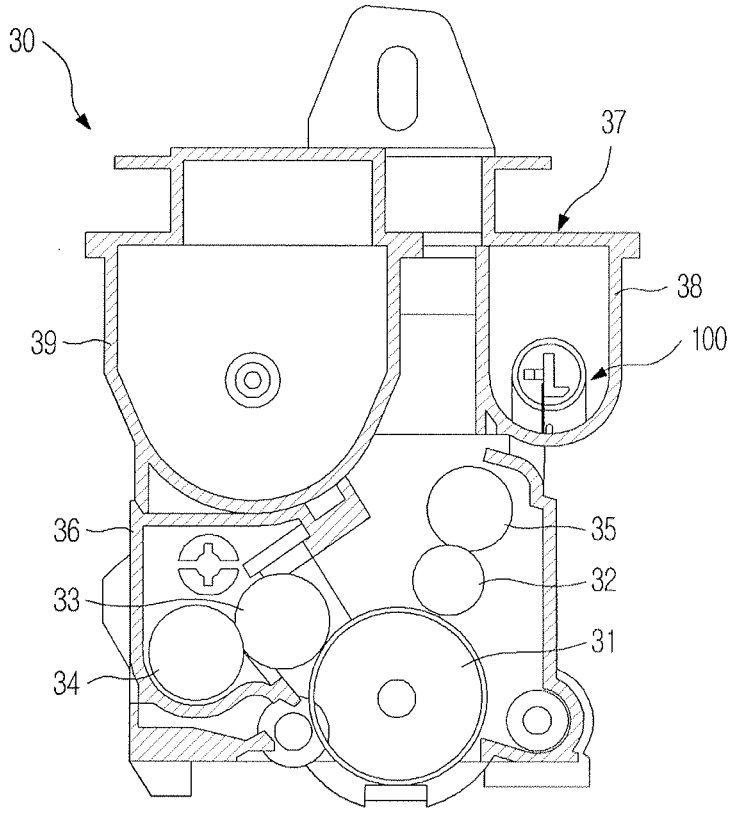
FIG. 3 is a sectional view of the developing unit.

FIG. 1 is a view illustrating an interior configuration of an image forming apparatus according to an exemplary embodiment of the present general inventive concept. FIG. 2 is a perspective view illustrating an exterior appearance of a developing unit. FIG. 3 is a sectional view of the developing unit.

As illustrated in FIG. 1, the image forming apparatus 1 may include a body 10 defining an exterior appearance of the image forming apparatus 1, a supply unit 20 to supply paper P stored therein, a developing unit 30 to form a developer image on the paper P supplied via the supply unit 20, a Light Scanning Unit (LSU) 40 to form an electrostatic latent image on a photosensitive body 31 of the developing unit 30, a fusing unit 50 to fuse developer transferred to the paper P, a paper discharge unit 60 to discharge the paper P, on which the image has been completely formed, out of the body 10, and a double-sided printing unit 70 to return the paper P, on a surface of which the image has been completely formed, to the developing unit 30.

The supply unit 20 may serve to supply the paper P to the developing unit 30, and may include a paper cassette 21 separably mounted to the body 10, a knock-up plate 22 installed in the paper cassette 21 to load the paper P thereon, and a pickup roller 24 to pick up the paper S on the knock-up plate sheet by sheet so as to transmit the paper P to the developing unit 30. Feed rollers 11 may be installed in the body 10 to deliver the paper P picked up by the pickup roller 24 to the developing unit 30.

The light scanning unit 40 may irradiate light containing image information to the photosensitive body 31, so as to form an electrostatic latent image on the photosensitive body 31.

The fusing unit 50 may serve to fuse the developer image formed on the paper P by applying heat and pressure to the paper P. The fusing unit 50 may include a heating roller 52 having a heater 51, and a press roller 53 to press the paper P using the heating roller 52. As the paper P receives heat and pressure while passing through a gap between the heating roller 52 and the press roller 53, the developer image on the paper P may be fused to the paper P.

The paper discharge unit 60 may include a paper discharge roller 62 and serve to discharge the paper P, having passed through the fusing unit 50, out of the body 10.

The double-sided printing unit 70 may serve to return the paper P, on a surface of which the image has been completely formed, to the developing unit 30, so as to enable printing of both surfaces of the paper P. The double-sided printing unit 70 may include a double-sided printing guide 71 to define a return path of the printed paper P, and a series of return rollers 72 installed on the return path of the printed paper P to deliver the paper P.

The developing unit 30 may form the developer image on the paper P delivered from the paper supply unit 20. The developing unit 30, as illustrated in FIGS. 2 and 3, may include the photosensitive body 31 on the surface of which the electrostatic latent image is formed by the light scanning unit 40, a charging roller 32 to charge the photosensitive body 31, a developing roller 33 to develop the electrostatic latent image formed on the photosensitive body 31 into a developer image by supplying the developer to the photosensitive body 31, a supply roller 34 to supply the developer to the developing roller 33, a cleaning roller 35 to clean the charging roller 32, and a housing 36 defining an exterior appearance of the developing unit 30. A transfer roller 12 may be installed in the body 10 to transfer the developer image of the photosensitive body 31 to the paper P by pressing the paper P toward the photosensitive body 31.

A developer housing 37 to store the developer may be arranged in the developing unit 30. The developer housing 37 may serve to store the developer therein at normal times, and to supply the developer to the supply roller 34 during a printing operation.

The developer housing 37 may include a first developer housing 38 in which a developer delivery system 100 according to the exemplary embodiment of the present general inventive concept is provided, and a second developer housing 39 to store the developer delivered from the first developer housing 38.

Hereinafter, the developer delivery system 100 will be described in detail.

Figure 4:
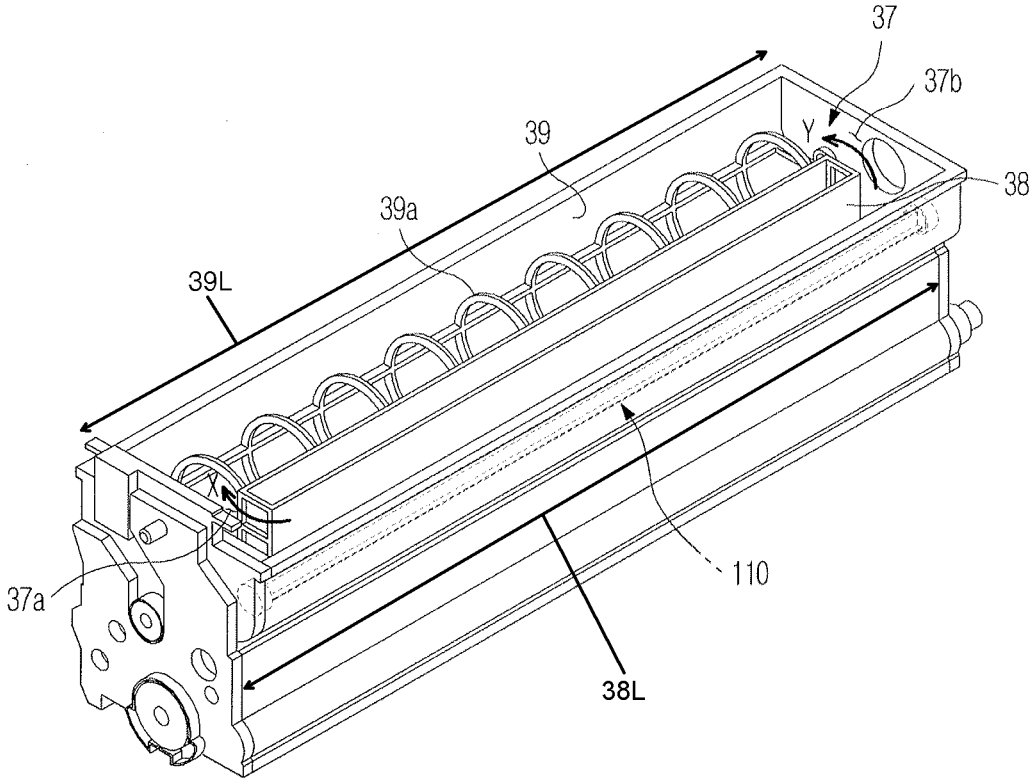
FIG. 4 is a perspective view illustrating an interior configuration of a developer housing.
Figure 5:
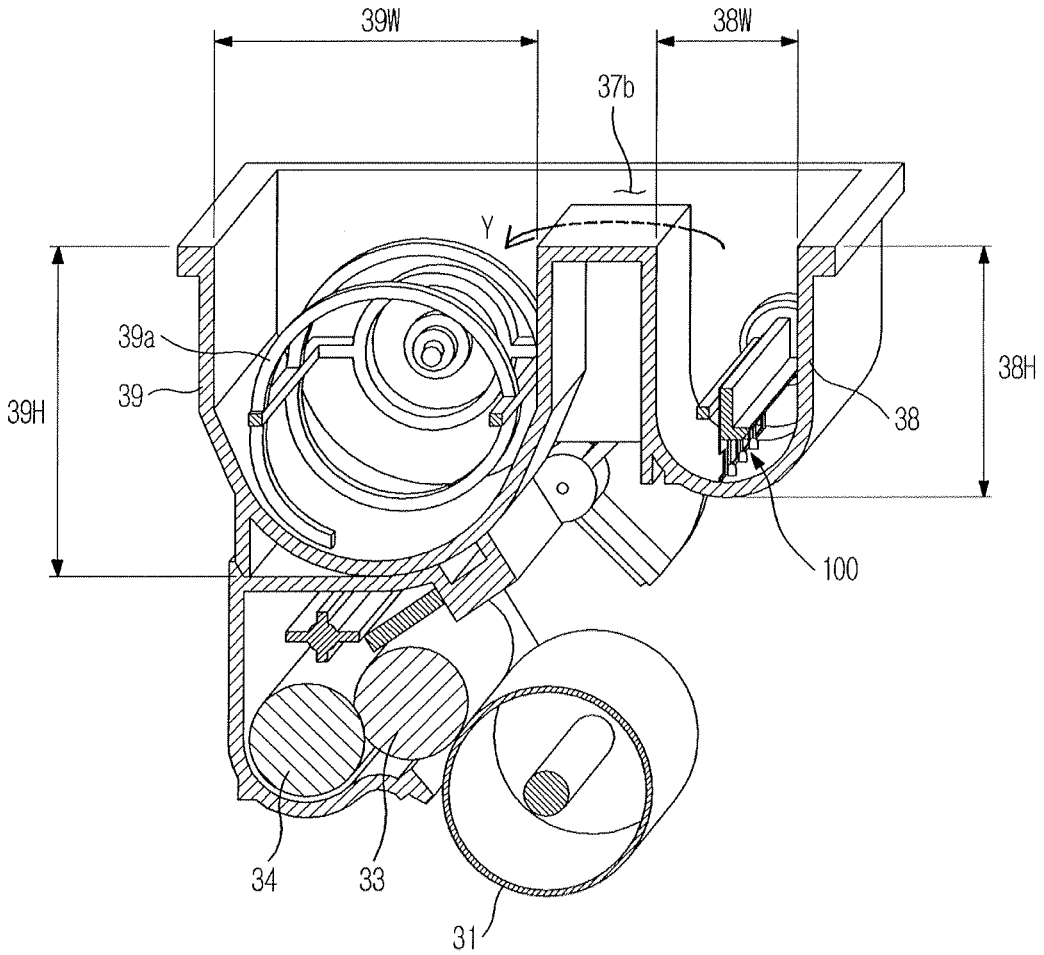
FIG. 5 is a detailed view illustrating the interior of the developer housing.
Figure 6:
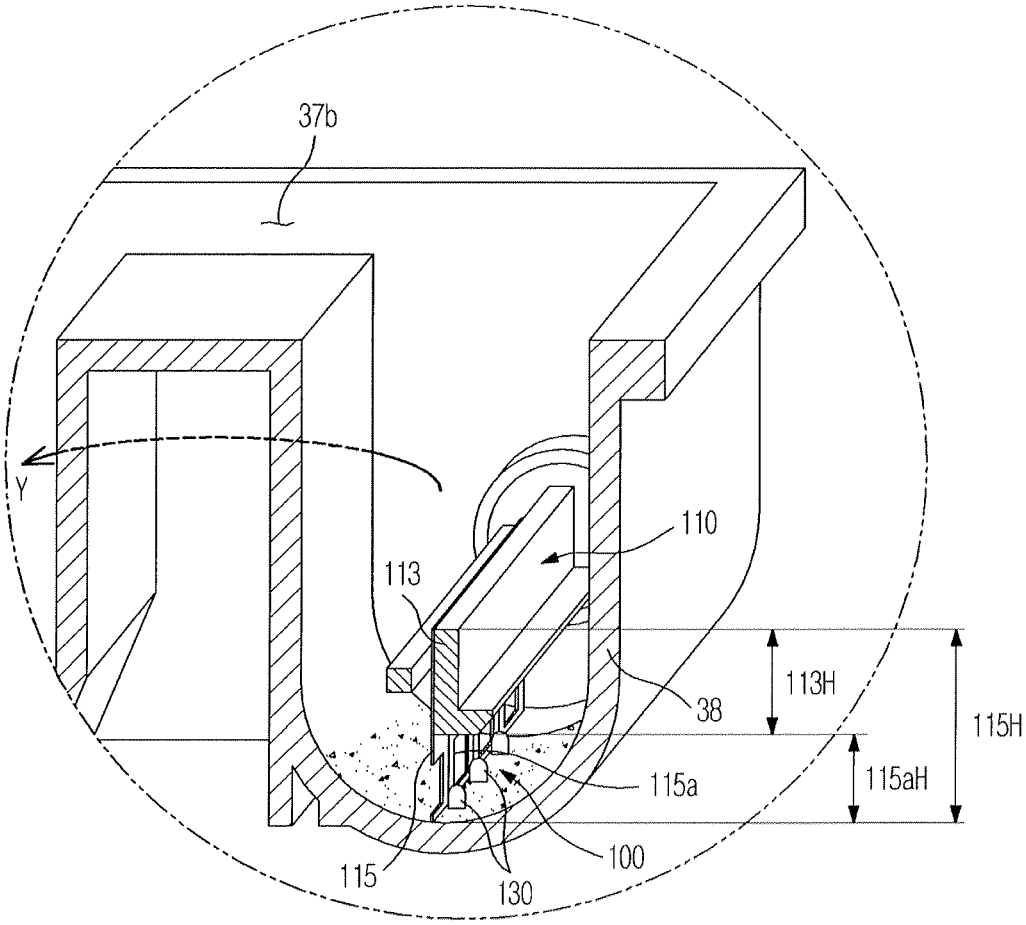
FIG. 6 is a detailed view illustrating a developer delivery system.
Figure 7A:
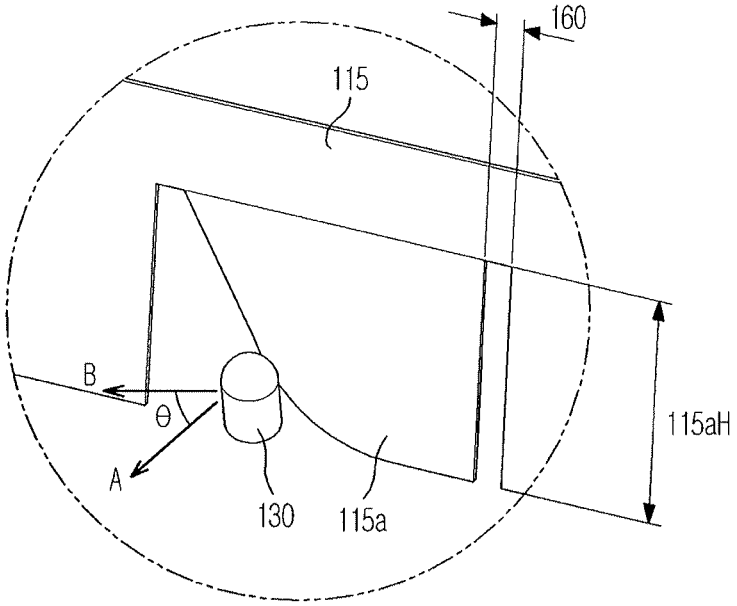
FIGS. 7A and 7B are views illustrating a mutual operational relationship of a delivery element and a protrusion.
Figure 7B:
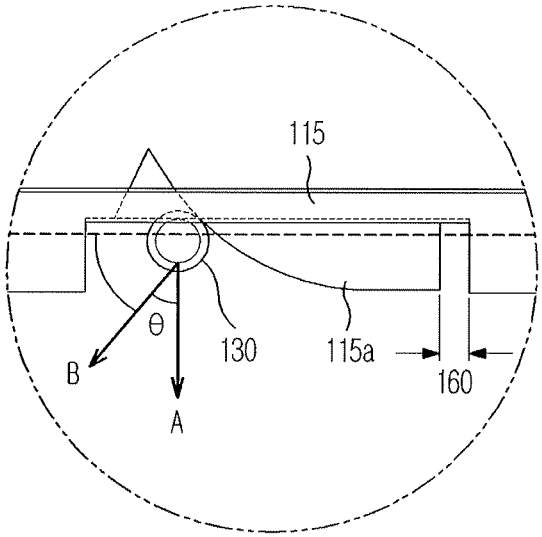
Figure 8A:
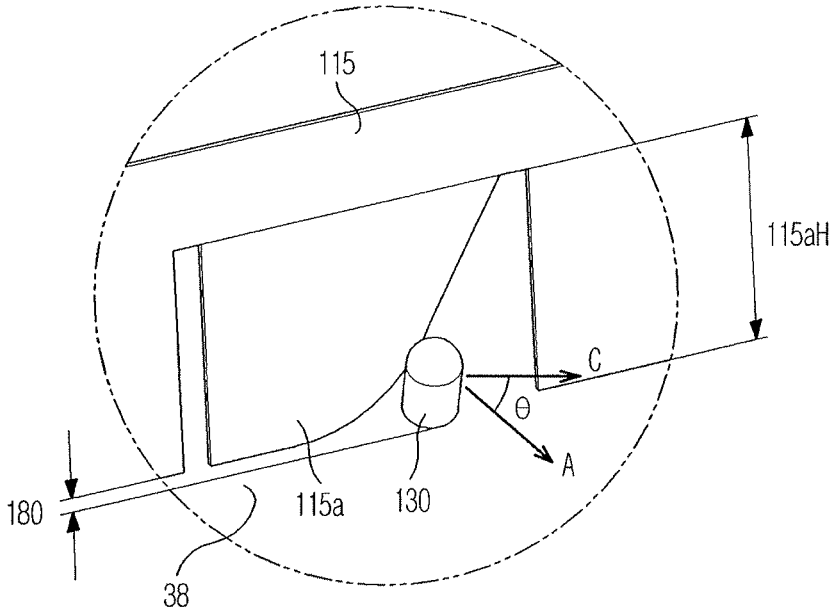
FIGS. 8A to 8C are conceptual views illustrating a developer delivery direction based on positional relationship of the delivery element and the protrusion.
Figure 8B:
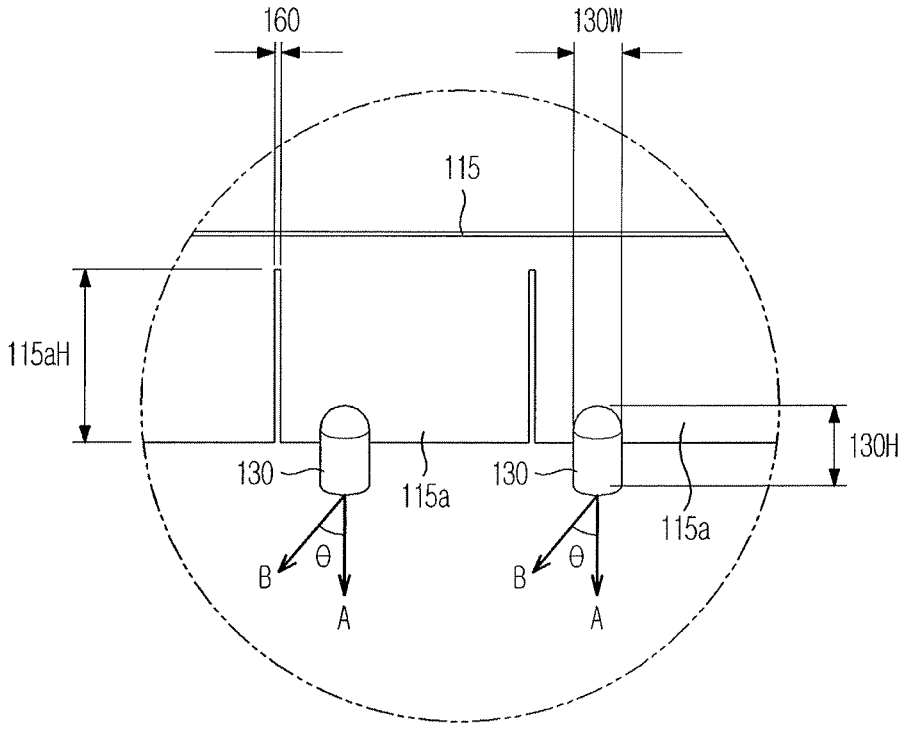
Figure 8C:
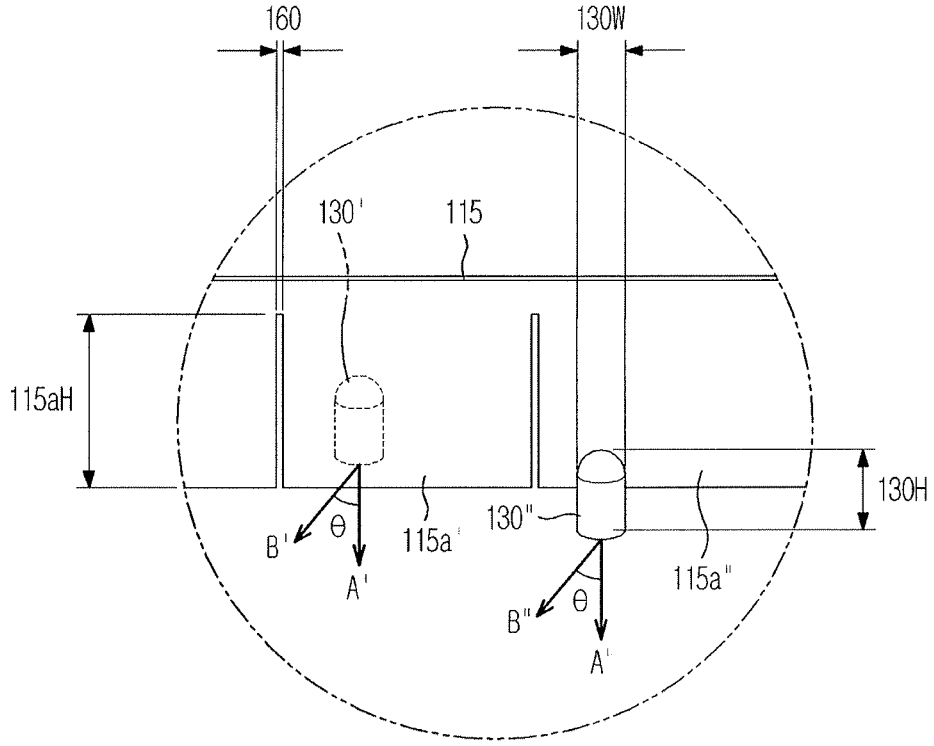

FIG. 4 is a perspective view illustrating an interior configuration of the developer housing, FIG. 5 is a detailed view illustrating the interior of the developer housing, FIG. 6 is a detailed view of the developer delivery system, FIGS. 7A and 7B are views illustrating the mutual operational relationship of a delivery element and a protrusion, and FIGS. 8A to 8C are conceptual views illustrating a developer delivery direction based on positional relationship of the delivery element and the protrusion.

As illustrated in FIGS. 4 to 6, the developer delivery system 100 may be provided in the first developer housing 38. The developer delivery system 100 may include the first developer housing 38 to store the developer, and a delivery unit 110 to deliver the developer while being rotated in the first developer housing 38. The width of the first developer housing is represented by 38W in FIG. 5 and the length of the first developer housing 38 is represented by 38L in FIG. 4.

The delivery unit 110 may include a rotating shaft 113 defining a rotatable body of the delivery unit 110, and a delivery member 115 rotatably coupled to the rotating shaft 113 and arranged to interfere with the developer via rotation thereof. The height of the delivery member 115 is represented by 115H in FIG. 6 and the height of the rotating shaft 113 is represented by 113H in FIG. 6

The rotating shaft 113 and the delivery member 115 may be arranged in a longitudinal direction of the developing unit 30. The delivery member 115 is an elastic thin film member.

The delivery member 115 may include at least one delivery element 115*a* arranged in an axial direction of the rotating shaft 113 with a height of 115*a*H, as illustrated in FIG. 6. The delivery element 115*a* may be formed by dividing the delivery member 115 into a plurality of independently movable elements. The space in a longitudinal direction between delivery member 115 and delivery element 115*a* is represented by 160 in FIGS. 7A, 7B, and 8A-8C. A space 180, illustrated in FIG. 8A, may exist between the delivery element 115*a* and an inner surface of the first developer housing 38.

Specifically, although a part of the delivery member 115 is integrally coupled to the rotating shaft 113, the remaining part of the delivery member 115 used to directly apply delivery force to the developer is divided to form the at least one independently movable delivery element 115*a*.

The first developer housing 38 may include at least one protrusion 130 protruding from an inner surface of the first developer housing 38 and configured to come into contact with the at least one delivery element 115*a* during rotation of the delivery unit 110. The protrusion 130 may be located within a rotation radius of the delivery element 115*a*.

As illustrated in FIGS. 7A and 7B, when the at least one protrusion 130 comes into direct contact with the at least one delivery element 115*a*, the protrusion 130 may act to change a developer delivery direction.

After the delivery unit 110 begins to be rotated and before the delivery element 115*a* comes into contact with the protrusion 130, a developer delivery force direction may be applied in a first direction A as a rotation tangential direction of the rotating shaft 113 of the delivery unit 110. In this case, a surface of the delivery element 115*a* faces the first direction A as the rotation tangential direction of the rotating shaft 113.

Then, when the delivery element 115*a* comes into contact with and interferes with the protrusion 130 arranged close to the left side of the surface of the delivery element 115*a* via further rotation of the delivery unit 110, the delivery element 115*a* may elastically deform so that a left portion of the surface of the delivery element 115*a* is bent, causing the surface of the delivery element 115*a* to face a second direction B that is deflected leftward from the first direction A. The second direction B is a direction along which a user may intend to apply a developer delivery force. In addition, an angle between the first direction A and the second direction B may be an acute angle θ.

Although FIGS. 7A and 7B illustrate an example wherein the protrusion 130 is arranged close to the left side of the surface of the delivery element 115*a*, on the contrary, the protrusion 130 may be arranged close to the right side of the surface of the delivery element 115*a* as illustrated in FIG. 8A. In this case, a right portion of the main surface of the delivery element 115*a* is bent, causing the main surface of the delivery element 115*a* to face a rightward deflected direction C.

As illustrated in FIG. 8B, one or more protrusions 130 may be aligned in a line in the axial direction of the rotating shaft 113 of the delivery unit 110. In this case, the main surface of the delivery element 115*a* faces the leftward deflected direction B and thus, developer delivery force acts in the leftward deflected direction B throughout the axial direction of the rotating shaft 113. Also, illustrated in FIGS. 8B and 8C is the height 130H of the protrusions 130 and the width 130W of the protrusions 130. Although the protrusions 130 illustrated in the figures have a diameter as a width, the protrusions may comprise of other shapes, such as rectangles.

As illustrated in FIG. 8C, one or more protrusions 130' and 130" may be arranged in zigzags in the axial direction of the rotating shaft 113 of the delivery unit 110. In this case, the developer delivery direction may be changed with a time interval. The protrusion 130' at a rear surface of the delivery member 115 may first interfere with a delivery element 115*a*', temporarily changing the developer delivery direction (from a direction A' to a direction B'). Subsequently, the protrusion 130" at a front surface of the delivery member 115 may interfere with a delivery element 115*a*", changing the developer delivery direction (from a direction A" to a direction B").

Considering the above principle described with reference to FIGS. 7A to 7C in conjunction with the delivery direction illustrated in FIGS. 4 to 6 according to the exemplary embodiment of the present general inventive concept, the developer may move between the first developer housing 38 and the second developer housing 39 through a front space 37*a* and a rear space 37*b* of the developer housing 37. The developer may be delivered in a direction "X" through the front space 37*a* and delivered in a direction "Y" through the rear space 37*b*.

The width of the second developer housing 39 is represented by 39W in FIG. 5 and the length of the second developer housing 39 is represented by 39L in FIG. 4. A height of the first developer housing 38 is represented by 38H in FIG. 5, and a height of the second developer housing 39 is represented by 39H in FIG. 5.

Now, the delivery of the developer through the rear space 37*b* will be described in more detail with reference to FIG. 6. Assuming that the delivery unit 110 may be rotated clockwise, the developer delivery force direction may be changed from the rotation tangential direction of the delivery unit 110 to the direction "Y" via mutual interference between the at least one protrusion 130 and the delivery element 115*a*. Accordingly, the developer in the first developer housing 38 may be delivered to the second developer housing 39 through the rear space 37*b*. As a delivery auger 39*a* delivers the developer within the second developer housing 39, consequently, the developer may be supplied to the supply roller 34, the developing roller 33, and the photosensitive body 31.

Hereinafter, an exemplary embodiment of the present general inventive concept will be described with reference to the accompanying drawing.

Figure 9:
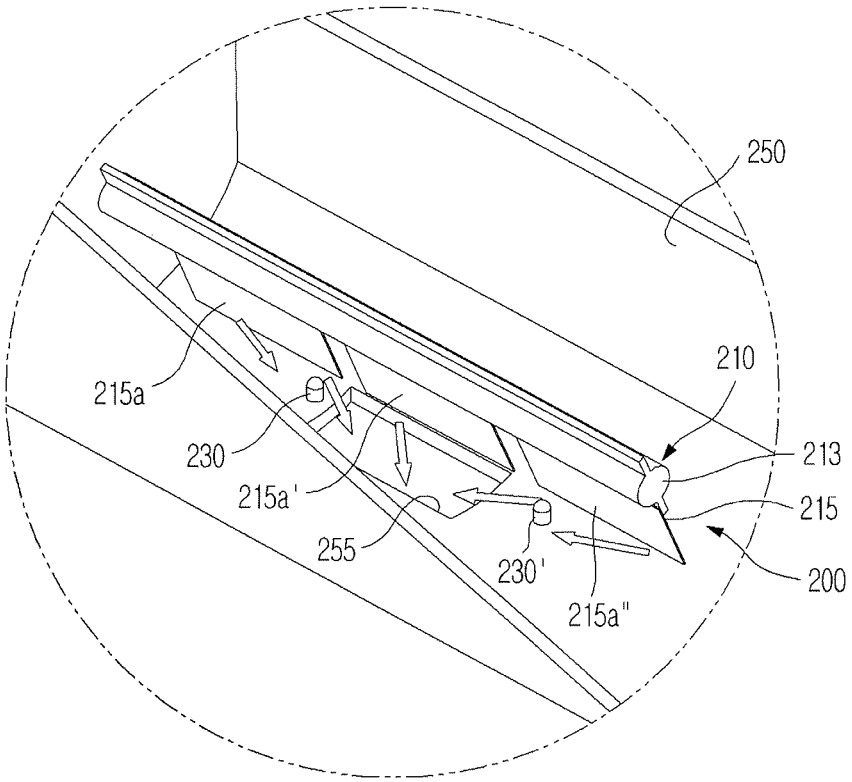
FIG. 9 is a view illustrating a developer delivery system according to an exemplary embodiment of the present general inventive concept.

FIG. 9 is a view illustrating a developer delivery system according to an exemplary embodiment of the present general inventive concept.

A developer delivery system 200 according to the present exemplary embodiment may include a developer housing 250 having a bottom outlet hole 255, and a delivery unit 210 to deliver the developer.

The delivery unit 210 may include a rotating shaft 213, and a delivery member 215 rotatably coupled to the rotating shaft 213 and arranged to come into contact with the developer via rotation thereof. The delivery member 215 may be divided into a plurality of delivery elements 215*a*, 215*a*', and 215*a*" arranged in an axial direction.

The developer housing 250 may include protrusions 230 and 230' arranged to interfere with the delivery elements 215*a* and 215*a*" arranged at axially opposite sides of the rotating shaft 213 of the delivery unit 210.

The delivery element 215*a* at the left side of the delivery unit 210 may interfere with the protrusion 230 arranged close to the right side of a surface of the delivery element 215*a*. The delivery element 215*a*" at the right side of the delivery unit 210 may interfere with the protrusion 230' arranged close to the left side of a surface of the delivery element 215*a*". The delivery element 215*a*' at the center of the delivery unit 210 may rotate without interference with the protrusions 230 and 230'.

Accordingly, the delivery element 215*a* at the left side of the delivery unit 210 may cause a rightward developer delivery force, and the delivery element 215*a*" at the right side of the delivery unit 210 may cause a leftward developer delivery force. The delivery element 215*a*" at the center of the delivery unit 210 may cause forward developer delivery force.

Thereby, the developer in the developer housing 250 may be delivered through the outlet hole 255.

The developer delivery system 200 according to the exemplary embodiment of FIG. 9 may be directly applied to the second developer housing 39 of FIGS. 1 to 6.

Hereinafter, a further exemplary embodiment of the present general inventive concept will be described with reference to the accompanying drawing.

Figure 10:
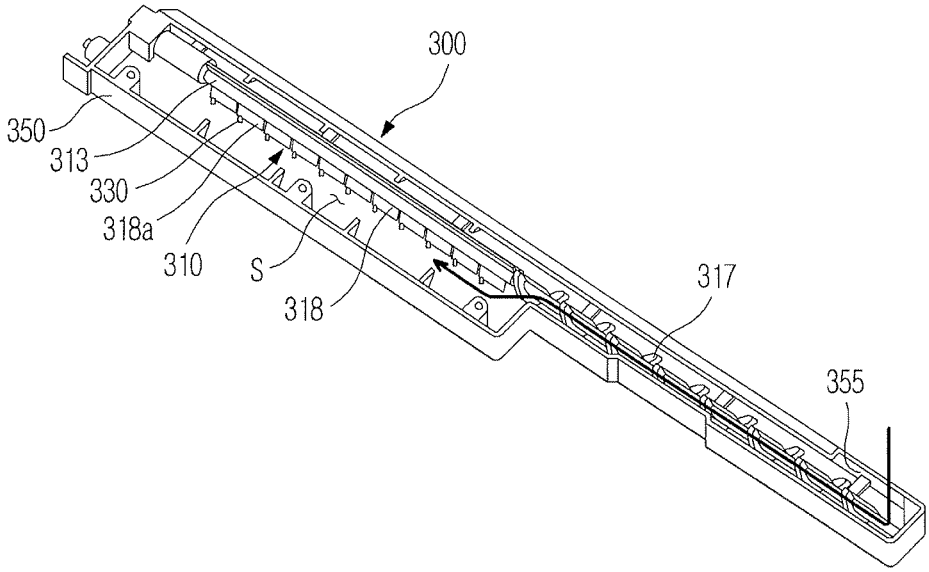
FIG. 10 is a view illustrating a developer delivery system according to an exemplary embodiment of the present general inventive concept.

FIG. 10 is a view illustrating a developer delivery system according to a further exemplary embodiment of the present general inventive concept.

A waste developer delivery system 300 may include a delivery unit 310 to deliver waste developer and a waste developer housing 350 to store the waste developer.

The waste developer housing 350 according to the exemplary embodiment of FIG. 10 generally has a bar shape, and may include a waste developer inlet hole 355 formed in one end thereof. Once waste developer is introduced through the waste developer inlet hole 355, the waste developer may be delivered in a longitudinal direction, thereby being delivered to a space S defined in the other end of the waste developer housing 350.

The delivery unit 310 may include a rotating shaft 313, an auger 317 coupled to a part of the rotating shaft 313, and a delivery member 318 coupled to the remaining part of the rotating shaft 313.

The auger 317 may serve to deliver the waste developer introduced through the waste developer inlet hole 355 to the space S. The delivery member 318 may be divided into a plurality of delivery elements 318*a*.

The waste developer housing 350 may include a plurality of protrusions 330 arranged close to the left side of a surface of each delivery element 318*a*, respectively.

The waste developer introduced through the waste developer inlet hole 355 may reach an entrance of the space S via operation of the auger 317. As the delivery member 318 is rotated clockwise, a developer delivery force direction may be changed leftward from a rotation tangential direction of the delivery unit 310 via interference between the respective delivery elements 318*a* and the protrusions 330.

In this manner, the waste developer may be uniformly delivered throughout the empty space S.

With the use of the developer delivery system and the waste developer delivery system as described above, the developer and the waste developer may be delivered even to a space that conventionally has difficulty in delivery.

Figure 11A:
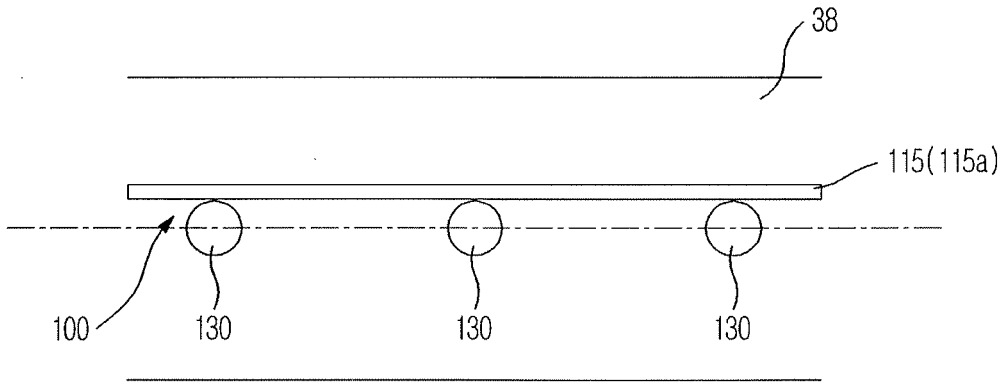
FIGS. 11A-11C are detailed views illustrating various positions of the protrusions within the developer housing.
Figure 11B:
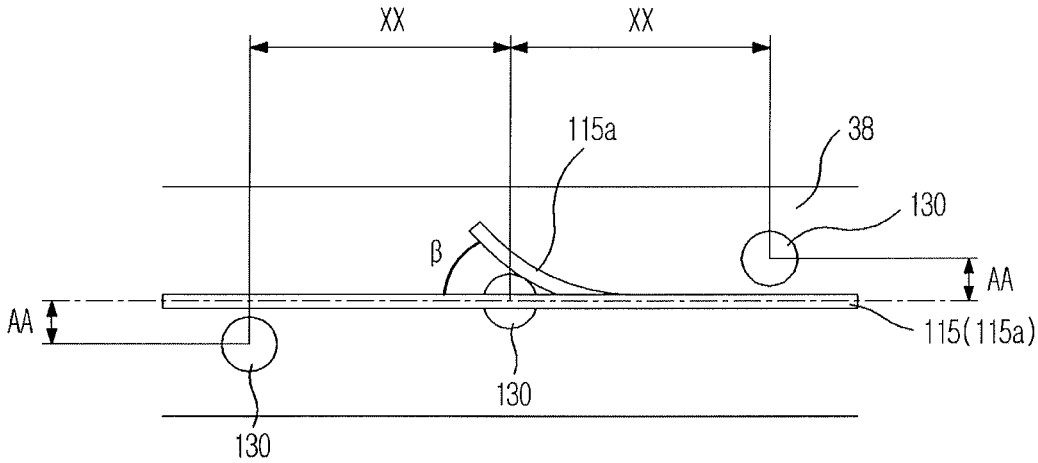
Figure 11C:
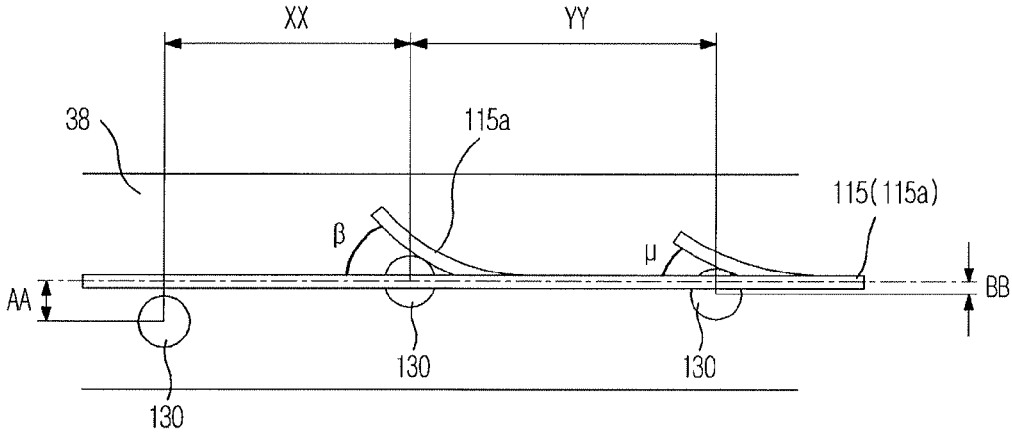

FIGS. 11A through 11C further define the placement of the protrusions 130 within the first developer housing 38. In particular, FIG. 11A illustrates the protrusions 130 in alignment with each other as well as aligned with the rotational axis of the delivery member 115. Each protrusion 130 is in contact with the delivery elements 115A on the delivery member 115, but each delivery element 115A is not yet bent.

FIG. 11B illustrates the protrusions 130 separated from one another in equal distances in the rotational direction of the delivery member 115. In particular, each protrusion 130 is separated from the next closest protrusion 130 by a distance of AA. The protrusions 130 are spaced apart from each other in a lengthwise direction by a distance XX. Further, FIG. 11B also illustrates a protrusion 130 contacting the delivery element 115*a*, wherein the delivery element 115*a* is fully extended at an angle β.

FIG. 11C illustrates the protrusions separated from one another in non-equal distances in the rotational direction of the delivery member 115. In particular, two protrusions are distanced from each other by a distance of AA while another distance BB represents a distance between two other protrusions. The distance between protrusions 130 both in the rotational direction of the delivery member 115 and the lengthwise direction of the delivery member 115, as illustrated with the arrow in FIG. 11C, may vary. For example, FIG. 11C illustrates that the distance distances XX and YY in the lengthwise direction between protrusions 130 are not equal. Also illustrated in FIG. 11C is the delivery element 115*a* fully extended at angle β as well as not As is apparent from the above description, in a developing unit and an image forming apparatus having the same according to the exemplary embodiment of the present general inventive concept, a delivery member to deliver developer may be deformed when coming into contact with a protrusion of a developer housing, enabling delivery of the developer in a predetermined direction.

Furthermore, the developer may be delivered in various directions or a predetermined direction.

Although a few exemplary embodiments of the present general inventive concept have been illustrated and described, it would be appreciated by those skilled in the art that changes may be made in these exemplary embodiments without departing from the principles and spirit of the general inventive concept, the scope of which is defined in the claims and their equivalents.

What is claimed is:

1. A developing unit detachably mounted in an image forming apparatus and comprising:

a developing roller and a supply roller to supply developer to a photosensitive body, the developing unit further comprising:

a developer housing to store the developer; and a delivery unit to deliver the developer by being rotated in the developer housing, wherein the delivery unit includes a rotating shaft, and a delivery member coupled to the rotating shaft and arranged to come into contact with the developer via rotation thereof, wherein the delivery member includes at least one delivery element arranged in an axial direction of the rotating shaft, and wherein the developer housing includes at least one protrusion arranged to interfere with the at least one delivery element along an axial direction of the rotating shaft during rotation of the delivery unit to form an angle with the axial direction of the rotating shaft.

2. The developing unit according to claim 1, wherein the at least one protrusion is arranged at a position close to any one side of the at least one delivery element on the basis of the center of the at least one delivery element, so as to cause bending of a side portion of the at least one delivery element.

3. The developing unit according to claim 2, wherein the at least one protrusion is arranged close to a left side of a surface of the at least one delivery element so as to come into contact with the at least one delivery element when the surface of the at least one delivery element is intended to face a direction deflected leftward from a rotation tangential direction of the delivery unit.

4. The developing unit according to claim 2, wherein the at least one protrusion is arranged close to a right side of a surface of the at least one delivery element so as to come into contact with the at least one delivery element when the surface of the at least one delivery element is intended to face a direction deflected rightward from a rotation tangential direction of the delivery unit.

5. The developing unit according to claim 3 or 4, wherein an angle between the surface of the at least one delivery element and the direction deflected from the rotation tangential direction of the delivery unit is an acute angle.

6. The developing unit according to claim 1, wherein:

the at least one delivery element is formed by dividing the delivery member into a plurality of delivery elements; and the at least one protrusion is arranged to correspond to the surface of the at least one delivery element.

7. The developing unit according to claim 6, wherein the at least one protrusion includes a plurality of protrusions arranged in a line in an axial direction of the rotating shaft of the delivery unit.

8. The developing unit according to claim 6, wherein the at least one protrusion includes a plurality of protrusions arranged in zigzags in an axial direction of the rotating shaft of the delivery unit.

9. The developing unit according to claim 1, wherein the delivery member includes an elastic thin film member.

10. An image forming apparatus having a developer delivery system wherein the developer delivery system comprises:

a developer housing to store a developer, and a delivery unit to deliver the developer by being rotated in the developer housing, wherein the delivery unit comprises:

a rotating shaft, and a delivery member coupled to the rotating shaft and adapted to provide the developer with delivery force via rotation thereof, wherein the delivery member comprises:

at least one delivery element arranged in an axial direction of the rotating shaft, and wherein the developer housing comprises:

a direction change element to change a direction of the developer delivery force by causing the at least delivery element to be bent along the axial direction in a predetermined direction during rotation of the delivery unit, the predetermined direction of the bent delivery element having an angle with the axial direction.

11. The image forming apparatus according to claim 10, wherein the direction change element includes at least one protrusion formed in the developer housing.

12. The image forming apparatus according to claim 11, wherein the at least one protrusion is arranged within a rotation radius of the at least one delivery element, so as to come into contact with the at least one delivery element.

13. The image forming apparatus according to claim 12, wherein the at least one protrusion is arranged at a position to apply deformation force to the at least one delivery element, so as to allow an orientation direction of a surface of the at least one delivery element to be changed from a first direction as a rotation tangential direction of the delivery unit to a second direction as a predetermined delivery force application direction.

14. A developer delivery system comprising:

a developer housing to store developer; and a delivery unit to deliver the developer by being rotated in the developer housing, wherein the delivery unit includes a rotating shaft, and a film member coupled to the rotating shaft and adapted to push and deliver the developer in a predetermined direction, wherein the film member includes at least one delivery element arranged in an axial direction of the rotating shaft, and wherein the developer housing includes at least one interference member formed in the developer housing and adapted to interfere with the at least one delivery element along an axial direction of the rotation shaft during rotation of the delivery unit so as to change a developer push direction having an angle with the axial direction of the rotation shaft.

15. A waste developer return unit comprising:

a waste developer housing into which waste developer is introduced; and a delivery unit to deliver the waste developer by being rotated in the waste developer housing, wherein the delivery unit includes a rotating shaft, and a delivery member coupled to the rotating shaft and adapted to push and deliver the developer in a predetermined direction via rotation thereof, wherein the delivery member includes at least one delivery element arranged in an axial direction of the rotating shaft, and wherein the waste developer housing includes at least one protrusion protruding from an inner surface of the waste developer housing and adapted to come into contact with the at least one delivery element so as to change an orientation direction of a surface of the at least one delivery element along the axial direction of the rotating shaft, the orientation direction having an angle with the axial direction of the rotating shaft.

16. A developing unit detachably mounted in an image forming apparatus and adapted to supply developer to a photosensitive body, the developing unit comprising:

a developer housing to store developer; and a drive shaft provided in the developer housing;

at least one delivery element installed to the drive shaft and adapted to agitate or deliver the developer upon receiving drive force from the drive shaft; and at least one protrusion provided in the developer housing to interfere with the at least one delivery element so as to allow the at least one delivery element to be oriented in a predetermined direction along the drive shaft during rotation of the at least one delivery element, the predetermined direction having an angle with the drive shaft.

17. A developing unit within an image forming apparatus comprising:

a developer housing to store a developer; and a delivery unit to rotatably deliver the developer along a developer delivery direction, wherein the delivery unit further comprises:

a rotating shaft and flexible driving member attached thereto to direct the developer along the developer delivery direction, and the developer housing further comprises:

a plurality of protrusions along an inner surface thereof to provide multiple developer delivery directions of the developer along an axial direction of the rotating shaft within the developer housing at separate time intervals to have an angle with the axial direction of the rotating shaft.

18. The developing unit of claim 17, wherein the plurality of protrusions each collide with the flexible driving member at separate time intervals during rotation of the driving member.

19. The delivery unit of claim 17, wherein the plurality of protrusions each collide with the flexible driving member at different locations thereon, causing multiple developer delivery directions of the developer within the developer housing.

20. A method of modifying developer delivery direction within a developer unit of an image forming apparatus comprising:

rotating a delivery unit with an elongated delivery member within a developer housing of the developer unit; and colliding the delivery member with at least one protrusion positioned on an inner surface of the developer housing such that the delivery member is bent along the an axial direction of the delivery unit in a direction having an angle with the axial direction of the delivery unit.

21. The method of claim 20, wherein a plurality of protrusions are aligned along an axis parallel with the rotational axis of the delivery unit on the inner surface of the developer housing.

22. The method of claim 21, wherein the delivery member further comprises a plurality of delivery elements spaced apart from each other and elastically deformable upon colliding with the plurality of protrusions.

* * * * *